US006420841B2

(12) United States Patent
Van Vroonhoven

(10) Patent No.: US 6,420,841 B2
(45) Date of Patent: Jul. 16, 2002

(54) COLOR DISPLAY DEVICE

(75) Inventor: Jozef Cornelis Walterus Van Vroonhoven, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/745,878

(22) Filed: Dec. 22, 2000

(30) Foreign Application Priority Data

Dec. 24, 1999 (EP) ..... 99204537

(51) Int. Cl.[7] ..... G09G 1/04; H01J 26/62

(52) U.S. Cl. ..... 315/382.1; 315/14; 313/414; 313/412

(58) Field of Search ..... 315/3, 8, 94, 382.1, 315/14, 16, 382, 402; 313/414, 412, 449, 429, 422, 432, 447

(56) References Cited

U.S. PATENT DOCUMENTS 5,818,157 A * 10/1998 Stil et al. ..... 313/414
6,150,760 A * 11/2000 Tsuchiya et al. ..... 315/3
6,194,824 B1 * 2/2001 Ueda ..... 313/413
6,320,333 B1 * 11/2001 Ueda et al. ..... 313/414

FOREIGN PATENT DOCUMENTS

WO 96/06446 2/1996

* cited by examiner

*Primary Examiner*—Don Wong
*Assistant Examiner*—Chuc Tran

(57) ABSTRACT

A colour display device (19) is disclosed having an improved focus performance. In state-of-the-art colour display tubes, a static voltage is applied to the focusing electrode (23). This means that only one focus voltage is available for the entire range of beam currents. In general, due to the fact that the diameter of the electron beams (7,8,9) increases as the beam current increases, the focus voltage is a function of this beam current, which itself is determined by the cathode voltage. In this invention, a colour display device (19) is disclosed in which the voltage on the focusing electrode (23) is changed as a function of the cathode voltages, thereby significantly improving the focus performance.

5 Claims, 3 Drawing Sheets

COLOR DISPLAY DEVICE

BACKGROUND OF THE INVENTION

The invention relates to a colour display device provided with a colour display tube having a display window, an electron gun and a deflection unit, which electron gun comprises cathodes, a beam-forming section, a focusing electrode and a final electrode, viewed in the direction from the electron gun to the display window, to which voltages are applied during operation, said electron gun generating an electron beam, during operation, that is deflected by the deflection unit to scan the display window in lines so as to form a picture, the colour display device further comprising electronic means generating a video signal at a pixel frequency.

A colour display device as described in the opening paragraph can for instance be provided with a colour display tube as disclosed in U.S. Pat. No. 5,818,157. The electron gun according to this prior-art specification comprises cathodes, a beamforming section having a plurality of electrodes for extracting the electrons from the cathodes and for forming the electron beams, which enter the main lens that is formed by the focusing electrode and the final electrode.

Such a colour display device drives the colour display tube with varying voltages on the cathodes and static voltages on the other electrodes. The varying voltages on the cathodes determine the beam currents, which have a more or less linear relationship with the light output of the colour display device.

In practice, these colour display devices have some limitations. For instance, it appears that when the light output changes also the sharpness of the picture changes. This is an unwanted effect and it deteriorates the focus performance of the colour display tube.

BRIEF SUMMARY OF THE INVENTION

It is an object of the invention to provide a colour display device of the kind described in the opening paragraph, which is capable of creating a picture of improved harpness by overcoming the mentioned limitation of the prior-art colour display device.

This object is realized with a colour display device of the invention, that is characterized in that the voltage on the focusing electrode is varied as a function of the voltages on the cathode.

The invention is based on the insight that the voltage needed for focusing the electron beam is dependent on the beam current. This beam current is determined by the voltage applied to drive the cathode, that is the cathode voltage. This makes it advantageous to have the cathode voltage determine the voltage on the focusing electrode, that is the focus voltage. In this way, it is achieved that the electron beam is well focused for all beam currents.

In a preferred embodiment, the voltage on the focusing electrode varies at the same rate as the pixel frequency. In this embodiment, the focus voltage is adjusted to the cathode voltage for every position on the display window, that is for each pixel. This results in a picture that is in focus for all light output levels at all positions on the display window. For this embodiment, it is necessary to adjust the focusing voltage at the same rate as the pixel frequency. The pixel frequency, or video frequency, is the frequency needed for driving the individual pixels of a colour display tube. This pixel frequency is proportional to the product of the number of pixels and the frame frequency. The frame frequency gives the number of times the picture is refreshed per second. The pixel frequency may be quite high, for instance, in high-resolution computer monitors higher than 100 MHz.

In a further embodiment, the voltage on the focusing electrode during scanning a line of a picture is a function of the average of the voltages on the cathodes during scanning said line.

On the one hand, this embodiment renders less accurate results compared to the preferred embodiment, because for a given line the voltage on the focusing electrode is. fixed. On the other hand, it needs a much lower frequency for adjusting the voltage on the focusing electrode. The cathode voltage across an entire line is measured, the average cathode voltage is calculated and this value is used for determining the adjustment of the voltage on the focusing electrode. This procedure requires an electronic memory, because the data of the cathode voltage on a line have to be collected to determine the accompanying voltage on the focusing electrode, and this has to be done before the information of this line is displayed.

In a still further embodiment, the voltage on the focusing electrode during scanning the lines of a picture is a function of the average of the voltages on the cathodes during scanning the lines of a picture. In this case, the cathode voltage is also averaged over the lines, so that an average cathode voltage over an entire picture, or as it is often called, a frame, is obtained. This embodiment is even less accurate, because now the focusing voltage is fixed for an entire picture. The frequency with which the focusing voltage is adjusted is low, namely the frame frequency. Although the focusing voltage is constant throughout a picture, this embodiment still is a significant improvement on the prior art, where the focusing voltage is static with respect to time.

In another embodiment, the colour display device comprises an electronic memory containing data describing the relation between the voltage on the cathodes and the voltage on the focusing electrode.

For adjusting the focusing voltage as a function of the cathode voltage, it is required to know the relationship between the cathode voltage, the beam current and the focusing voltage. This relationship is programmed, for instance in the form of a table, in an electronic memory, so that, at a certain cathode voltage, the corresponding focusing voltage is read from the memory.

These and other aspects of the colour display device according to the present invention will be apparent from and elucidated by way of non-limitative examples with reference to the drawings and the embodiments described hereinafter.

DETAILED DESCRIPTION OF THE INVENTION

Figure 1:
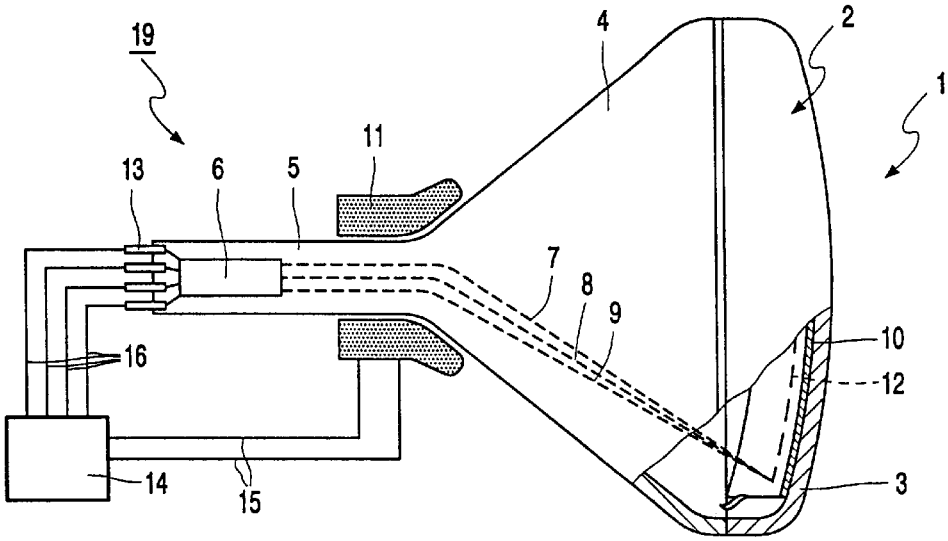
FIG. 1 is a sectional view of the colour display device.

A colour display tube 1 shown in FIG. 1 comprises an evacuated glass envelope 2 with a display window 3, a funnel-shaped part 4 and a neck portion 5. On the inside of the display window 3, a screen 10 having a pattern of for example lines or dots of phosphors luminescing in different colours—e.g. red, green and blue—may be arranged. A colour selection electrode 12 is positioned at a distance from the screen 10.

During operation of the colour display tube, an electron gun 6, arranged in the neck portion 5, sends electron beams 7, 8, 9 through the colour selection electrode 12 to the screen 10 so that the phosphors will emit light. The electron beams 7, 8, 9 are at an angle with respect to each other so that, at the proper mask to screen distance, the electron beams only impinge on the phosphors of the associated colour.

A deflection unit 11 ensures that the electron beams systematically scan the screen 10. In general, a deflection unit 11 comprises means for deflecting the electrons in the horizontal direction and in the vertical direction. To achieve this, the deflection device 11 generates a horizontal and a vertical deflection field, which are commonly called the line and frame field, respectively; the line direction being in the plane of the electron beams 7, 8, 9. The electron beams scan horizontal lines starting at the top and ending at the bottom of the screen.

Apart from the colour display tube 1, the colour display device 19 comprises an electronic circuitry 14 for driving the colour display tube 1. This electronic circuitry 14 is connected to pins 13 of the colour display tube 1 by leads 16. It is also connected to the deflection unit 11 by leads 15. The electronic circuitry 14 generates, among other things, the voltages required for driving the electron gun, including the cathode voltage and the dynamic voltage that is applied to the focusing electrode 23. The cathode voltages are generated by video amplifiers (not explicitly shown), which are part of the electronic circuitry 14, in order to create a picture on the display window 3. The cathode voltages determine the beam current of the electron beams 7, 8, 9 and hence the light output of the colour display device 19.

Figure 2:
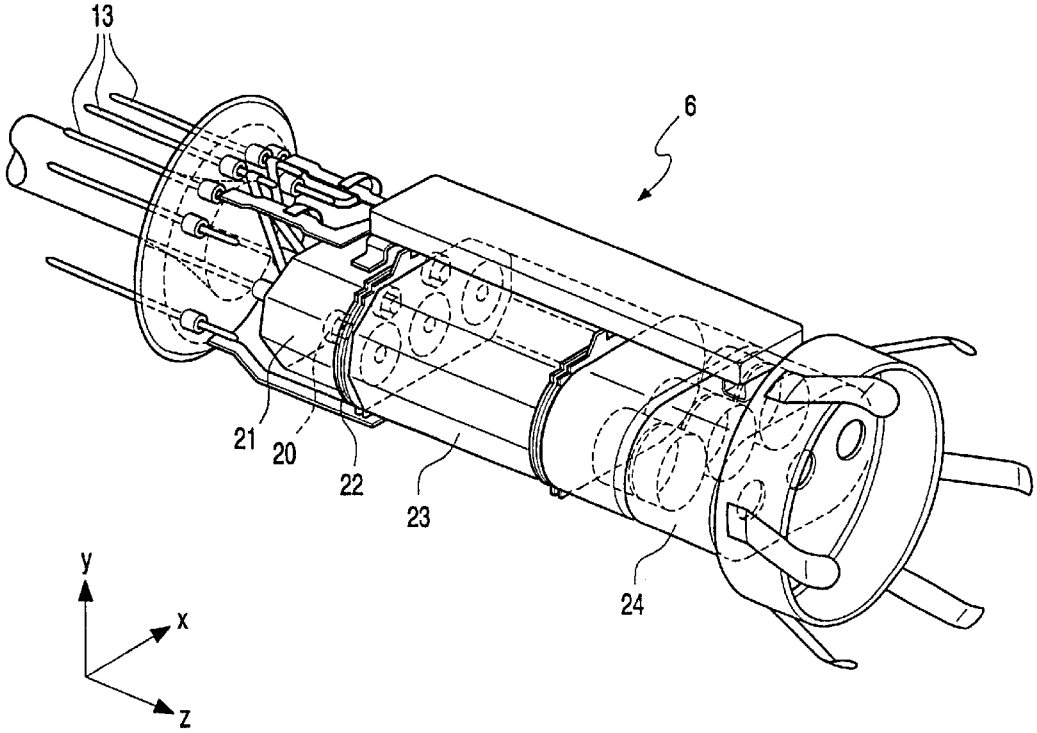
FIG. 2 is a perspective, transparent view of the electron gun used in the colour display device of FIG. 1.

FIG. 2 shows, by way of example, the electron gun 6 in a schematic, semi-transparent view. The electron gun 6 comprises a beam-generating section, customarily referred to as the triode. This triode consists of three in-line electron sources 20, e.g. cathodes, a first electrode 21 and a second electrode 22. In most contemporary electron guns, the first electrode 21 is called the grid 1 (G1) and is connected to ground; the second electrode 22 (G2) is generally connected to a potential in the range 500–1000 V. The electron gun 6 also comprises a beam-forming or prefocusing section. In this example, the prefocusing section has a prefocusing lens formed by the electrodes 22 and 23, which electrode 23 is the focusing electrode, which is normally provided with an operating potential in the range between 5 kV and 9 kV. The prefocusing section can also comprise additional electrodes. More complex lens systems are possible for the prefocusing section; thus-this example should not be considered as limitative.

In the electron gun, as shown in this example, the main focusing section is formed by the main lens, comprising the focusing electrode 23 and the final electrode—also referred to as the anode—24. The main lens creates a focused image of the virtual object, as generated by the triode section. A typical operating potential for the final electrode is in the range 25–35 kV.

The invention is not limited to electron guns of this type. The invention is also applicable to electron guns—referred to as DAF (Dynamic Astigmatism and Focus) guns-comprising an additional quadrupole lens between the focusing electrode and the main lens by introducing an extra electrode that is dynamically driven. Furthermore, the invention can be used for electron guns with more complex main lens structures like, for instance, the DML (Distributed Main Lens) as disclosed in EP-B-0725972.

Figure 3:
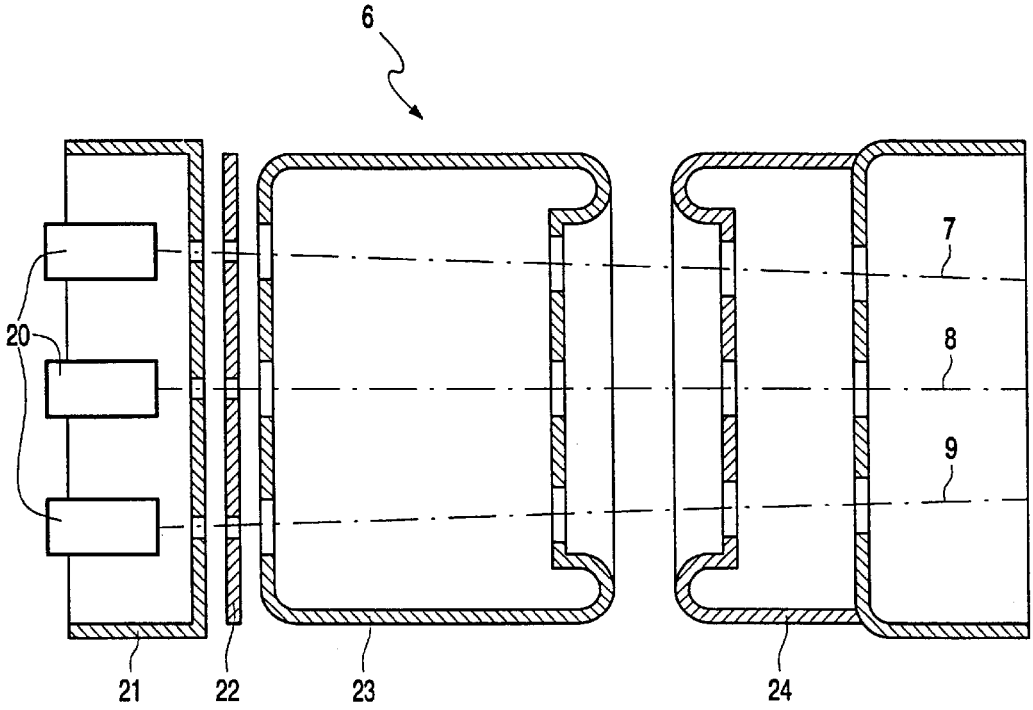
FIG. 3 is a schematic, cross-sectional view of the electron gun of FIG. 2 in the plane of the electron beams.

FIG. 3 is a schematic cross-sectional view of the electron gun 6 shown in FIG. 2, as seen in the plane of the electron beams 7, 8, 9. This Figure schematically shows the paths of the electron beams 7, 8, 9 generated by the cathodes 20 and their passage through the various electrodes 21–24.

Figure 4:
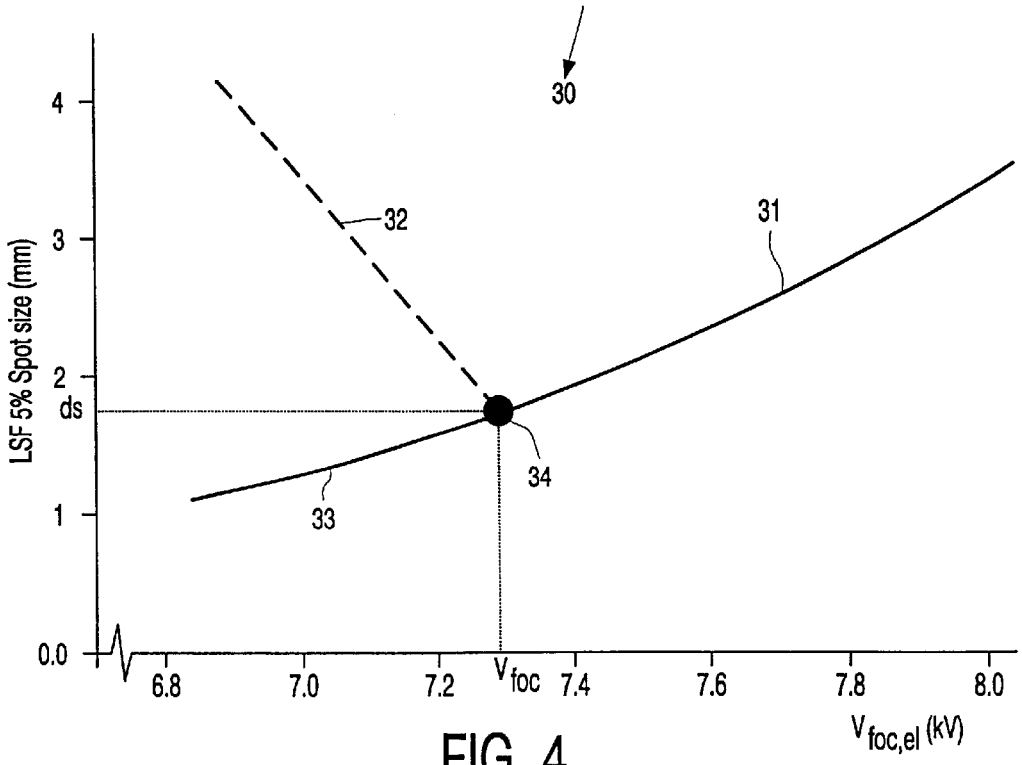
FIG. 4 shows a diagram of an example of the relation between the voltage on the focusing electrode and the spot size.

FIG. 4 gives an example of a focus characteristic 30 of an electron beam 7, 8 or 9 at a certain beam current as it hits the screen 10. In this Figure, the spot size is presented as a function of the voltage on the focusing electrode 23, here denoted by $V_{foc,el}$. For the spot size the 5% value of the Line Spread Function (LSF) has been chosen. The line formed by the two parts 31 and 33 indicates the size of the core of the spot, while the dashed line 32 indicates the size of the haze that projects from the core of the spot.

For a certain value of the voltage on the focusing electrode 23, the electron spot 34 is in focus, this means that its size is minimal. This situation is reached when the voltage on the focusing electrode 23 equals the focus voltage $V_{foc}$. The spot size for this situation is indicated by ds. In this example $V_{foc}$=7.3 kV and ds=1.8 mm. When the voltage on the focusing electrode 23 is lower than $V_{foc}$, the main lens of the electron gun 6 is too strong, leading to a spot on the screen 10 that has a small core 33 and a haze 32 projecting from the spot. By increasing the voltage, the core grows and the haze shrinks until the voltage reaches the value $V_{foc}$ at which the spot is just in focus, denoted by reference numeral 34. By further increasing the voltage, the core of the spot further grows but haze is not visible 31. The minimal spot size is obtained in the 'in focus' point 34.

Figure 5A:
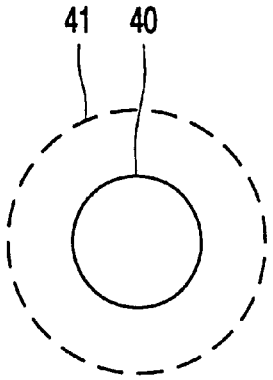
FIG. 5 shows an example of a typical spot shape for different values of the voltage on the focusing electrode.
Figure 5B:
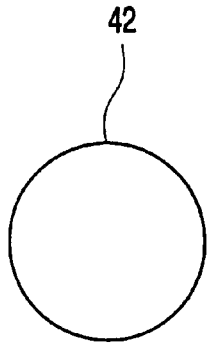
Figure 5C:
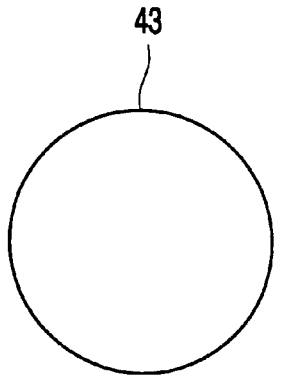

A cross-sectional view of the electron beam 7, 8 or 9 as it hits the screen 10 is shown in FIGS. 5A, 5B and 5C, respectively, for three situations: the voltage on the focusing electrode $V_{foc,el}$, is lower, equal and higher than $V_{foc}$. FIG. 5A gives the spot with a small core 40 and haze 41, FIG. 5B gives the 'in focus' spot 42 and FIG. 5C gives the blooming spot 43. This situation applies at a given beam current. It is evident that a focus characteristic as given in FIG. 4 can be given for all beam currents. In general, a larger beam current will also lead to a larger 'in focus' spot size. However, the behavior of the corresponding voltage $V_{foc}$, as a function of the beam current can not be easily predicted. It is the result of the electron-optical design of the electron gun.

Figure 6:
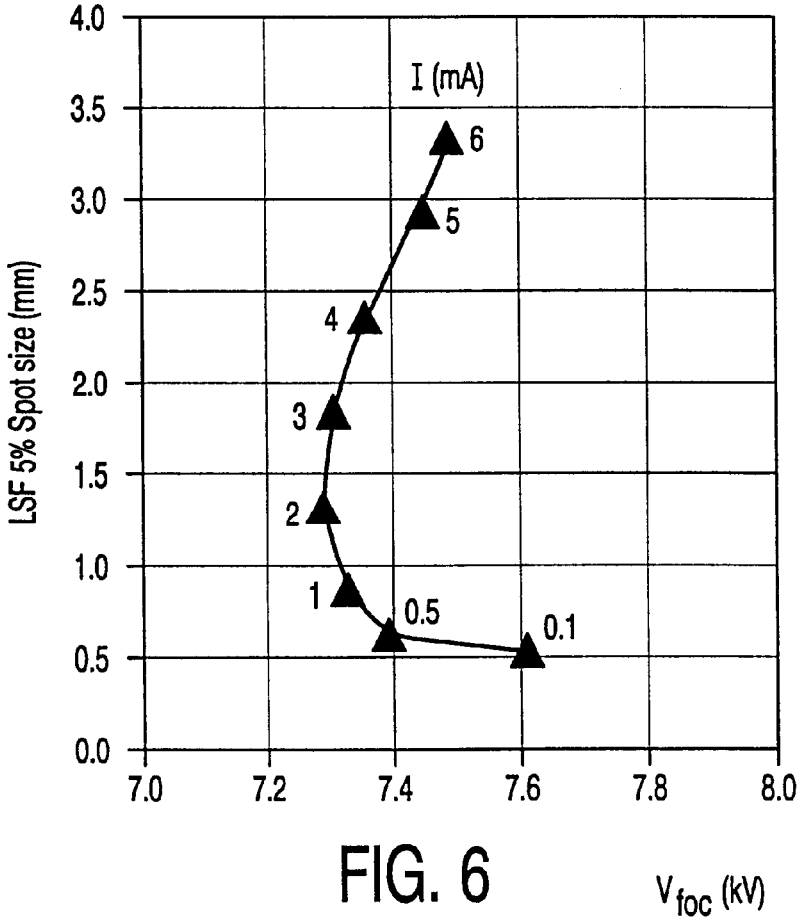
FIG. 6 shows a diagram of an example of the relation between the focus voltage and the spot size.

For that reason, often a second kind of focus characteristic is given, as is shown in the diagram of FIG. 6. This diagram gives the relation between spot size and focus voltage $V_{foc}$ for different values of the beam current. The beam current is given as a parameter value, for example, in the range often used for TV applications, i.e. measuring values between 0.1 and 6 mA.

FIG. 6 clearly shows that the focus voltage is not a constant when the beam current is varied. This means that for prior-art colour display devices 19, where only one static value for the voltage on the focusing electrode 23 is used, the picture will be out of focus for beam currents other than the one at which the colour display device 19 is focused. From this it will be clear that the focus performance of the colour display device is improved when the voltage on the focusing electrode 23 is adapted as a function of the beam current, which itself is a consequence of the cathode voltage.

In terms of focus performance, the best way to adapt the voltage on the focusing electrode 23 is to adapt the voltage for each point on the screen. This means that this voltage has to change with the same frequency as the video signal. This will lead to an expensive electronic circuitry 14 in the colour display device 19 because the focusing electrode 23 has to be driven at the rate of the video frequency over a range of several hundred volts or more, depending on the electron-optical design of the electron gun 6.

In a colour display tube 1, in general, three cathodes 20 are present and only one focusing electrode 23. Therefore, the cathode voltages have to be averaged to come to one value that is used for determining the voltage on the focusing electrode 23. This averaging can be done in different ways, for instance by taking the arithmetic average or by weighing the cathode voltages with the relative contribution of the three colours—red, green, blue—to the total light output of the colour display tube 1.

The electronic circuitry can be simplified by having a constant value of the voltage on the focusing electrode 23 over a line. This strongly lowers the frequency with which the voltage on the focusing electrode has to be adapted. This implies that the information for that line has to be stored in an electronic memory, the average cathode voltage is calculated and the corresponding focusing voltage is applied to the colour display tube 1. An even simpler version is obtained by additionally averaging the cathode voltage over a frame. This causes the voltage on the focusing electrode 23 to be changed with the frame frequency. For this embodiment, the cathode voltages of an entire frame have to be collected, for instance by storing them in an electronic memory, and the average has to be determined. In this way, the voltage on the focusing electrode is adjusted for every frame or every picture, so that this situation is still superior to the way in which the electron gun 6 is driven in accordance with the prior art.

In an electron gun 6, the electron optical design—that is, among other things, the apertures in the electrodes, the distances between the electrodes, the thicknesses of the electrodes and the voltages on the electrodes—of the beam-generating section determines the relation between the cathode voltage and the beam current. The focus voltage is, among other things, determined by the beam diameter in the main lens, which itself is a function of the beam current. Thus, there is a direct relation between the cathode voltage and the required focus voltage. This relation can be incorporated in a colour display device 19, for instance, by programming an electronic memory using a table containing the cathode voltage and the accompanying focus voltage.

Independent of the frequency with which the voltage on the focusing electrode is changed—for instance, with the video, the line or the frame frequency—this enables a direct coupling between the cathode voltage and the focus voltage.

It will be clear to a person skilled in the art that this invention is not limited to the examples given here. Alternative embodiments for dynamically changing the voltage on the focusing electrode 23 will reach the same objective, as will different constructions and different operating conditions of the electron gun 6.

A few examples: the invention has been described for an electron gun with a prefocusing lens in between the electrodes 22 and 23, however, the prefocusing lens can also comprise additional electrodes; the main lens can have a more complex structure and the electron gun 6 can be of the DAF type. The invention is written for an electron gun 6 in which the electron beams 7,8,9 are generated by driving the cathodes 20, with the first electrode 21 being connected to ground. The invention is also applicable to electron guns in which the cathodes are grounded and the first electrode is used for the drive voltage.

Furthermore, the invention can be applied in display devices provided with a monochrome display tube.

Summarizing, a colour display device 19 is disclosed having an improved focus performance. In state-of-the-art colour display tubes, a static voltage is applied to the focusing electrode 23. This means that only one focus voltage is available for the entire range of beam currents. In general, due to the fact that the diameter of the electron beams 7,8,9 increases as the beam current increases, the focus voltage is a function of this beam current, which itself is determined by the cathode voltage. In this invention a colour display device 19 is disclosed in which the voltage on the focusing electrode 23 is changed as a function of the cathode voltages, thereby significantly improving the focus performance.

What is claimed is:

1. A colour display device (19) provided with a colour display tube (1) having a display window (3), an electron gun (6) and a deflection unit (11), which electron gun (6) comprises cathodes (20), a beam-forming section (21,22), a focusing electrode (23) and a final electrode (24), viewed in the direction from the electron gun (6) to the display window (3), to which voltages are applied during operation, said electron gun (6) generating electron beams (7,8,9), during operation, that are deflected by the deflection unit (11) to scan the display window (3) in lines so as to form a picture, the colour display device (19) further comprising electronic means (14) generating a video signal at a pixel frequency, characterized in that the voltage on the focusing electrode (23) is varied as a function of the voltages on the cathodes (20).

2. A colour display device (19) as claimed in claim 1, characterized in that the voltage on the focusing electrode (23) varies at the same rate as the pixel frequency.

3. A colour display device (19) as claimed in claim 1, characterized in that the voltage on the focusing electrode (23) during scanning a line of a picture, is a function of the average of the voltages on the cathodes (20) during scanning said line.

4. A colour display device (19) as claimed in claim 3, characterized in that the voltage on the focusing electrode (23) during scanning the lines of a picture is a function of the average of the voltages on the cathodes (20) during scanning the lines of a picture.

5. A colour display device (19) as claimed in claim 1, characterized in that the colour display device (19) comprises an electronic memory containing data describing the relation between the voltage on the cathodes (20) and the voltage on the focusing electrode (23).

* * * * *